US006701714B2

(12) United States Patent
Burd et al.

(10) Patent No.: US 6,701,714 B2
(45) Date of Patent: Mar. 9, 2004

(54) GAS TURBINE COMBUSTOR

(75) Inventors: Steven W. Burd, Cheshire, CT (US); Kenneth S. Siskind, South Glastonbury, CT (US); Charles B. Graves, South Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/010,297

(22) Filed: Dec. 5, 2001

(65) Prior Publication Data

US 2003/0101731 A1 Jun. 5, 2003

(51) Int. Cl.[7] ..... F02C 1/00; F02G 3/00
(52) U.S. Cl. ..... 60/752; 60/766
(58) Field of Search ..... 60/752, 760, 766, 60/772, 740, 753, 754, 755, 756, 757, 758, 759, 796

(56) References Cited

U.S. PATENT DOCUMENTS 4,064,300 A * 12/1977 Bhangu ..... 428/120
4,269,032 A * 5/1981 Meginnis et al. ..... 60/754
4,302,941 A 12/1981 DuBell
4,838,031 A * 6/1989 Cramer ..... 60/753
5,216,886 A * 6/1993 Ewing ..... 60/752
5,435,139 A * 7/1995 Pidcock et al. ..... 60/757
5,598,697 A * 2/1997 Ambrogi et al. ..... 60/39.02
5,758,503 A * 6/1998 DuBell et al. ..... 60/752
6,237,344 B1 * 5/2001 Lee ..... 60/754
6,402,464 B1 * 6/2002 Chiu et al. ..... 415/116
6,530,225 B1 * 3/2003 Hadder ..... 60/772

OTHER PUBLICATIONS

Lefebvre, A., "Gas Turbine Combustion", McGraw Hill Book Company, 1983, Chapter 8—Heat Transfer, p. 282, Section "Pressure" and Fig. 8.20.*

* cited by examiner

*Primary Examiner*—Justine R. Yu
*Assistant Examiner*—Han L Liu
(74) *Attorney, Agent, or Firm*—Bachman & LaPointe, P.C.

(57) ABSTRACT

A combustor for a gas turbine engine is provided which includes a plurality of liner segments and a support shell. The support shell includes an interior and an exterior surface, a plurality of mounting holes, and a plurality of impingement coolant holes extending through the support shell. Each liner segment includes a panel and a plurality of mounting studs. The panel includes a face surface and a back surface, and a plurality of normal or inclined coolant holes extending therethrough. The back surface of the panel has a surface profile for improving the heat transfer properties of a liner segment without substantial increase in pressure drop across the combustor.

11 Claims, 4 Drawing Sheets

(1 of 4 Drawing Sheet(s) Filed in Color)

GAS TURBINE COMBUSTOR

BACKGROUND OF THE INVENTION

This invention relates to combustors for gas turbine engines and, more particularly, to double wall gas turbine combustors.

Gas turbine engine combustors are generally subject to high thermal loads for prolonged periods of time. To alleviate the accompanying thermal stresses, it is known to cool the walls of the combustor. Cooling helps to increase the usable life of the combustor components and therefore increase the reliability of the overall engine.

In one cooling embodiment, a combustor may include a plurality of overlapping wall segments successively arranged where the forward edge of each wall segment is positioned to catch cooling air passing by the outside of the combustor. The forward edge diverts cooling air over the internal side, or "hot side", of the wall segment and thereby provides film cooling for the internal side of the segment. A disadvantage of this cooling arrangement is that the necessary hardware includes a multiplicity of parts. A person of skill in the art will recognize that there is considerable value in minimizing the number of parts within a gas turbine engine, not only from a cost perspective, but also for safety and reliability reasons. Specifically, internal components such as turbines and compressors can be susceptible to damage from foreign objects carried within the air flow through the engine.

A further disadvantage of the above described cooling arrangement is the overall weight which accompanies the multiplicity of parts. A person of skill in the art will recognize that weight is a critical design parameter of every component in a gas turbine engine, and that there is considerable advantage to minimizing weight wherever possible.

In other cooling arrangements, a twin wall configuration has been adopted where an inner wall and an outer wall are provided separated by a specific distance. Cooling air passes through holes in the outer wall and then again through holes in the inner wall, and finally into the combustion chamber. An advantage of a twin wall arrangement compared to an overlapping wall segment arrangement is that an assembled twin wall arrangement is structurally stronger. A disadvantage to the twin wall arrangement, however, is that thermal growth must be accounted for closely. Specifically, the thermal load in a combustor tends to be non-uniform. As a result, different parts of the combustor will experience different amounts of thermal growth, stress, and strain. If the combustor design does not account for non-uniform thermal growth, stress, and strain, then the usable life of the combustor may be negatively affected.

U.S. Pat. No. 5,758,503, assigned to the assignee of the instant application, discloses an improved combustor for gas turbine engines. The advantage of the combustor of the '503 patent is its ability to accommodate a non-uniform heat load. The liner segment and support shell construction of the present invention permits thermal growth commensurate with whatever thermal load is present in a particular area of the combustor. Clearances between segments permit the thermal growth without the binding that contributes to mechanical stress and strain.

The support shell and liner construction minimizes thermal gradients across the support shell and/or liner segments, and therefore thermal stress and strain within the combustor. The support shell and liner segment construction also minimizes the volume of cooling airflow required to cool the combustor. A person of skill in the art will recognize that it is a distinct advantage to minimize the amount of cooling airflow devoted to cooling purposes. Improved heat transfer at minimal change in liner-shell pressure drop is beneficial. At fixed combustor aerodynamic efficiency, the foregoing translates to reduced coolant requirements.

It would be highly advantageous to improve the heat transfer efficiency of a gas turbine engine combustor while not adversely effecting the pressure drop across the combustor or cooling flow requirement.

It is a further object of the present invention to provide a combustor as above wherein improved heat transfer is achieved with negligible increase in pressure drop.

It is an object of the present invention to provide a lightweight combustor for a gas turbine engine having improved heat transfer efficiency.

SUMMARY OF THE INVENTION

According to the present invention the foregoing objects are achieved by providing a combustor for a gas turbine engine is provided which includes a plurality of liner segments and a support shell. The support shell includes an interior and an exterior surface, a plurality of mounting holes, and a plurality of impingement coolant holes extending through the support shell. Each liner segment includes a panel and a plurality of mounting studs. The panel includes a face surface and a back surface, and a plurality of coolant holes extending therethrough. The back surface of the panel has a surface profile for improving the heat transfer properties of a liner segment without substantial increase in pressure drop across the twin walls formed by the liner segment and support shell of the combustor.

Further features and advantages of the present invention will become apparent in light of the detailed description of the best mode embodiment thereof, as illustrated in the accompanying drawings.

BRIEF DESCRIPTION OF THE DRAWINGS

The patent or application file contains at least one drawing executed in color. Copies of this patent or patent application publication with color drawings(s) will be provided by the office upon request and payment of the necessary fee.

DETAILED DESCRIPTION

Figure 1:
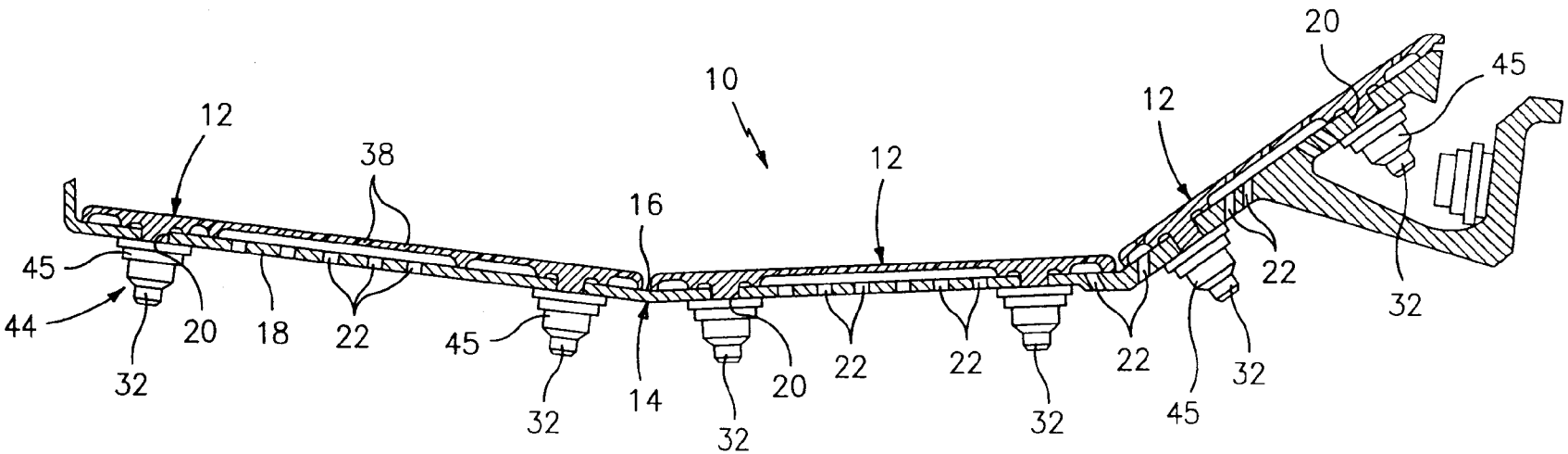
FIG. 1 is a diagrammatic partial view of a combustor.

Referring to FIG. 1, a combustor 10 for a gas turbine engine includes a plurality of liner segments 12 and a support shell 14 separated from each other at a gap distance of between 25 to 200 mils, preferably 60 to 100 mils. The support shell 14 shown in FIG. 1 is a cross-sectional partial view of an annular shaped support shell. Alternatively, the combustor 10 may be formed in other shapes, such as a cylindrical support shell (not shown). The support shell 14 includes interior 16 and exterior 18 surfaces, a plurality of mounting holes 20, and a plurality of impingement coolant holes 22 extending through the interior 16 and exterior 18 surfaces. The coolant or impingement holes 22 have diameter of between 15 to 60 mils, preferably 20 to 35 mils, with hole densities of between 5 to 50, preferably 10 to 35 holes/inch$^2$. The holes 22 are spaced at intervals of between 4 to 16 diameters at preferred densities.

Figure 2:
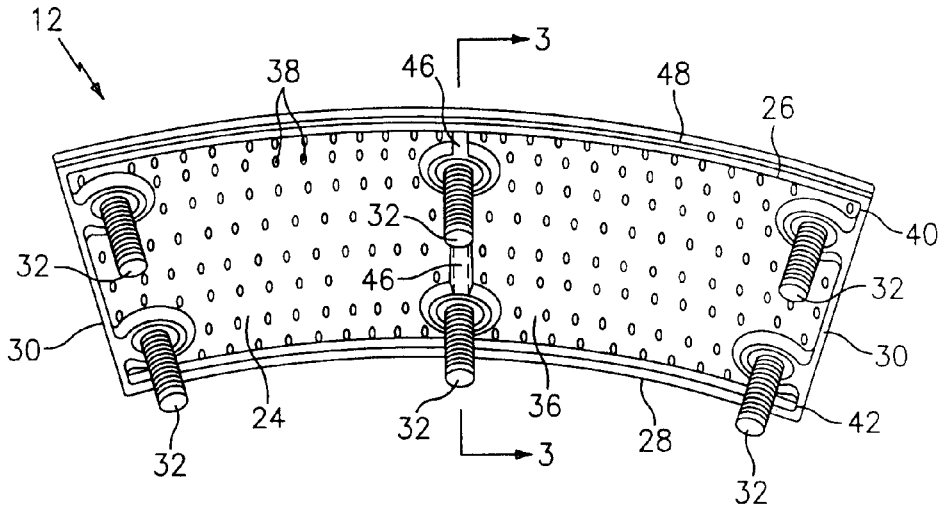
FIG. 2 is a perspective view of a liner segment.
Figure 3:
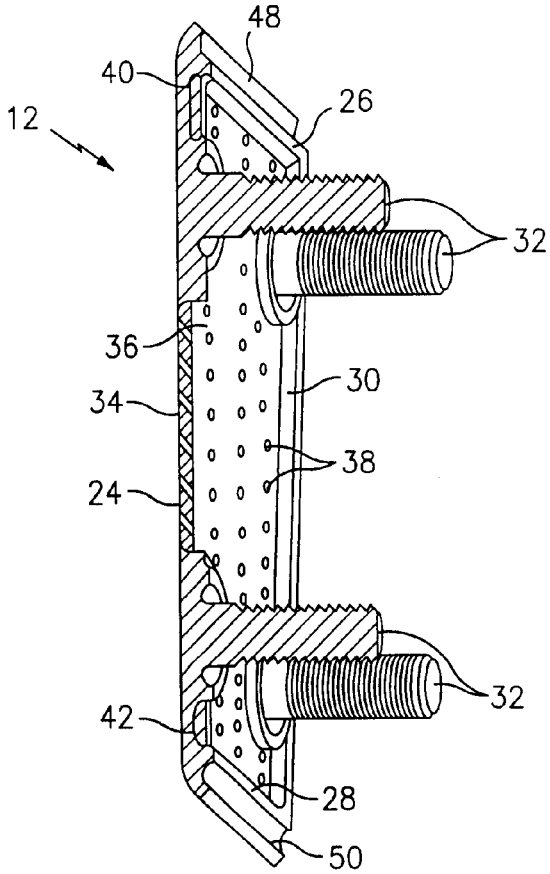
FIG. 3 is a cross-sectional view of the liner segment shown in FIG. 2 cut along section line 3—3.

Referring to FIGS. 2 and 3, each liner segment 12 includes a panel 24, a plurality of mounting studs 32 and may include a forward wall 26, a trailing wall 28 and a pair of side walls 30. The panel 24 includes a face surface 34 (see FIG. 3) and a back surface 36, and a plurality of coolant holes 38 extending therethrough which may be normal or inclined to surfaces 34 and 36. The coolant holes 38 have a diameter of between 15 to 60 mils, preferably 20 to 35 mils, with hole densities of between 10 to 150, preferably 20 to 120 holes/inch$^2$. When present, the forward wall 26 is positioned along a forward edge 40 of the panel 24 and the trailing wall 28 is positioned along a trailing edge 42 of the panel 24. The side walls 30 connect the forward 26 and trailing walls 28. The forward 26, trailing 28, and side walls 30 extend out from the back surface 36 a particular distance. The plurality of mounting studs 32 extend out from the back surface 36, and each includes fastening means 44 (see FIG. 1). In the preferred embodiment, the studs 32 are threaded and the fastening means 44 is a plurality of locking nuts 45.

Referring to FIG. 2, ribs which extend out of the back surface 36 of the panel 24 may be provided for additional structural support in some embodiments. The height of the rib 46 away from the back surface 36 of the panel 24 is less than or equal to that of the walls 26, 28, 30.

Referring to FIG. 3, a forward flange 48 may extend out from the forward wall 26 and a trailing flange 50 may extend out from the trailing wall 28. The forward 48 and trailing 50 flanges have arcuate profiles which facilitate flow transition between adjacent liner segments 12, and therefore minimize disruptions in the film cooling of and exposed areas between the liner segments 12.

Each liner segment 12 is formed by casting for several reasons. First, casting permits the panel 24, walls 26, 28, 30, and mounting studs 32 elements of each segment 12 to be integrally formed as one piece unit, and thereby facilitate liner segment 12 manufacturing. Casting each liner segment 12 also helps minimize the weight of each liner segment 12. Specifically, integrally forming the segment 12 elements in a one piece unit allows each element to draw from the mechanical strength of the adjacent elements. As a result, the individual elements can be less massive and the need for attachment medium between elements is obviated. Casting each liner segment 12 also increases the uniformity of liner segment 12 dimensions. Uniform liner segments 12 help the uniformity of the gap between segments 12 and the height of segments 12. Uniform gaps minimize the opportunity for binding between adjacent segments 12 and uniform segment heights make for a smoother aggregate flow surface.

Referring to FIG. 1, in the assembly of the combustor 10, the mounting studs 32 of each liner segment 12 are received within the mounting holes 20 in the support shell 14, such that the studs 32 extend out on the exterior surface 18 of the shell 14. Locking nuts 45 are screwed on the studs 32 thereby fixing the liner segment 12 on the interior surface 16 of the support shell 14. Depending on the position of the liner segment 12 within the support shell 14 and the geometry of the liner segment 12, one or more nuts 45 may be permitted to move or "float" in slotted mounting holes to encourage liner segment 12 thermal growth in a particular direction. In all cases, however, the liner segment 12 is tightened sufficiently to create a seal between the interior surface 16 of the support shell 14 and the walls 26, 28, 30 (see FIGS. 2 and 3) of the segment liner 12. Washers can aid in the seal. These are placed between shell exterior surface and the nut.

Referring to FIG. 2, if the liner segment 12 does include ribs 46 for further structural support, the height of the rib 46 away from the back surface 36 of the panel 24 is less than or equal that of the walls 26, 28, 30, thereby leaving a gap between the rib 46 and the interior surface 16 of the support shell 14. The gap permits cooling air to enter underneath the rib 46, if required.

The novel features of the present invention will be described hereinbelow with particular reference to FIGS. 4 and 5.

Impingement heat transfer is an effective method of cooling liner segments of combustors for gas turbine engines by removing heat from the back surfaces of the liners. U.S. Pat. No. 5,758,503 employs such a scheme. Success of liner designs and their ability to meet durability goals relies on maximizing the aerodynamic efficiency and thermal effectiveness of the backside impingement. In order to maximize heat transfer capability, in the present invention high density surface augmentation is incorporated into the design of combustor liner segments.

Figure 4:
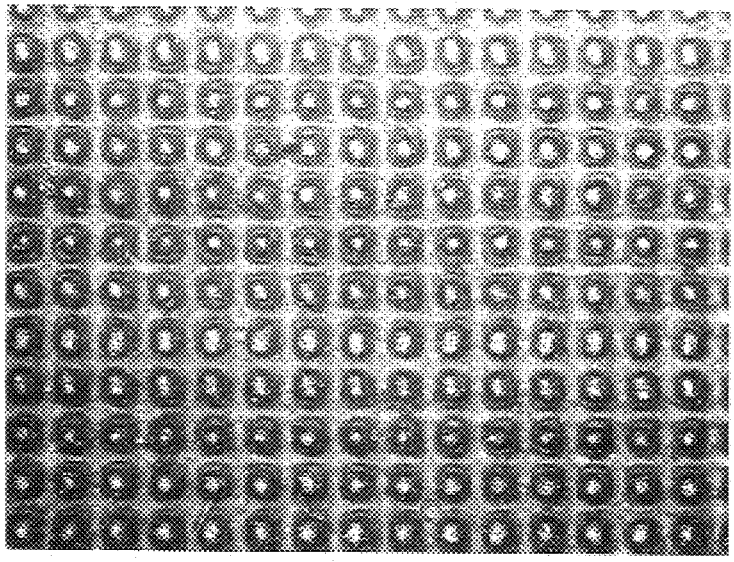
FIG. 4 is a perspective view of a preferred surface profile in accordance with the present invention.
Figure 5:
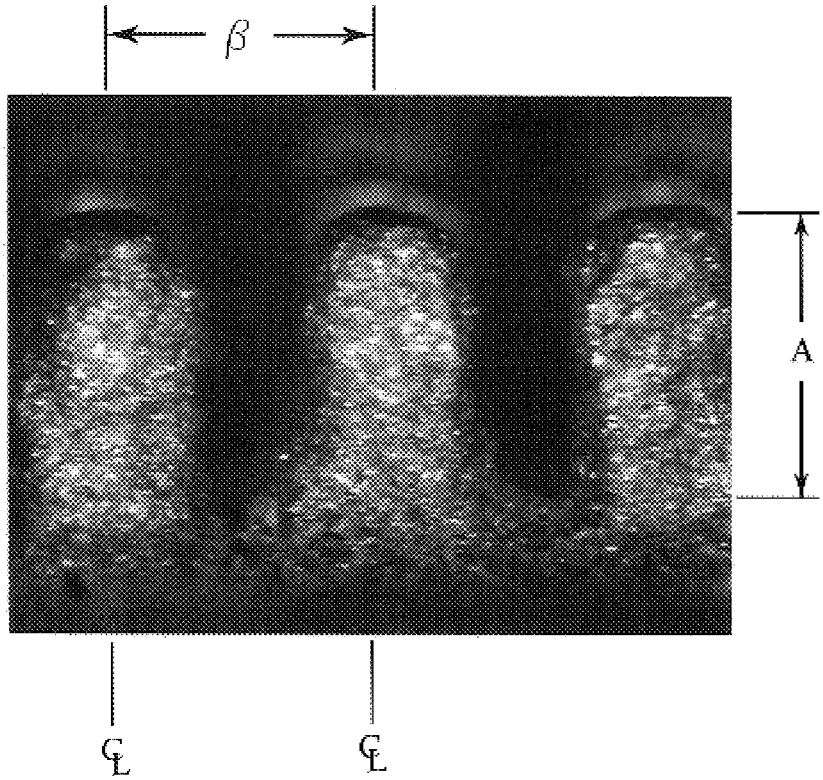
FIG. 5 is an enlarged sectional view of FIG. 4.

The area augmentation feature of the present invention as illustrated in FIGS. 4 and 5 comprises providing at least a portion of the back surface of the panel of a liner segment and surface profile for improving the heat transfer properties of the liner without substantially increasing the pressure drop across the combustor liner. The surface profile comprises a surface roughness which substantially increases the backside surface area for heat transfer at a negligible increase in pressure drop as compared to a smooth surface. By negligible pressure drop is meant a maximum increase in pressure drop of 10% or less, preferably 5% or less. The individual surface features may comprise square-base pins, circular-base pins, square-base pyramids, circular-base cones, tapered pin arrays and the like. Other embodiments may include pyramids with polygonal bases, frustums conical convex cones, concave cones, serpentine micro ribs, hemispheres, dimples which function to increase the surface area on the backside surface for purposes of increasing heat transfer. Surface features noted above are applied in an array on the back surface with small spacing distance therebetween. FIGS. 4 and 5 illustrate an example of a preferred surface pattern in accordance with the present invention.

The surface profile of the roughness elements is intended to be a geometrically regular and repeatable array of a given amplitude over a given sampling length and area. The amplitude, however, may be random so as to tailor performance or in instances in which the roughness is fabricated in a less than exact manner. The repeatability or random profile is characterized with peaks and valleys with specific spacing. These dimensions are formed as required to maximize heat transfer (between 20–50% increase relative to smooth/flat back baseline) and minimize increase in liner shell pressure drop (less than 10% increase in pressure drop, preferably less than 5%), i.e., scaled to the impingement boundary layer. The foregoing is achieved by the design of the surface profile. With reference to FIG. 5, the peak-to-valley heights, A, is less than 100 mils, preferably between 4 and 45 mils, and the spacing of the peaks taken from the center line of one peak to the center line of an adjacent peak, B in FIG. 5, is greater than or equal to 10 mils, preferably between 15 and 50 mils. In accordance with a preferred embodiment of the present invention, it is preferable that the array of the surface pattern be uniform as shown in FIG. 4 as a uniform array generally yields the most predictable and consistent performance with regard to negligible increase in liner-shell pressure drop and heat transfer efficiency.

Surface roughness may be fabricated by any well-known state of the art method, for example, die casting and the like. The method for fabricating the surface profile is limited only by cost considerations and the method forms no part of the present invention.

The surface profile increases the surface area available for convective heat transfer on the backside of the combustor liners. The surface profile can provide heat transfer surface areas up to and exceeding three times (preferably greater than 1.5 times and up to 4.75 times) the area of a flat/smooth surface not enhanced by the surface profile in accordance with the present invention while still maintaining a negligible increase in pressure drop. The level of enhancement of the heat transfer is dependent on the increase in the surface area and flow patterns which are obtained by the shape, size and spacing of the surface features which form the surface profile. The foregoing also controls and limits the pressure drop through the liner-shell arrangement. Provision of the surface profile on the backside of the combustor liners allows for a very high cooling efficiency along with a substantial reduction in the required air mass flow for cooling.

In accordance with the present invention, it has been found that up to a 50% increase in heat transfer efficiency, preferably between 20% and 50% can be obtained at a negligible increase in pressure drop with the surface augmentation in accordance with the present invention as set forth above when compared to a flat back surface.

The advantages of the present invention will be made clear from consideration of the following examples.

EXAMPLE

The performance of the invention was demonstrated via scaled experimentation. The experimental setup consisted of a simulated impingement shell that is separated by a gap distance (65 mils) from six cast metal plates having the surface profiles set forth in Table I. The shell was drilled with a series of impingement holes (20 mils diameter) positioned in a staggered arrangement at a hole density of approximately 27 holes per square inch. The impingement holes were spaced roughly 9.5 diameters apart. The holes were drilled through the shell plate perpendicular to its surfaces. The cast metal plates simulate a combustor panel. Six panels were cast in a combustor alloy with surface area features set forth in Table I and compare to a flat surface plate with no surface profile. Holes were drilled normal to the cast plates. The holes were drilled through the surface area augmentation as well. The holes were 20 mils in diameter in a staggered arrangement and at a hole density of 100 holes per square inch.

Figure 6:
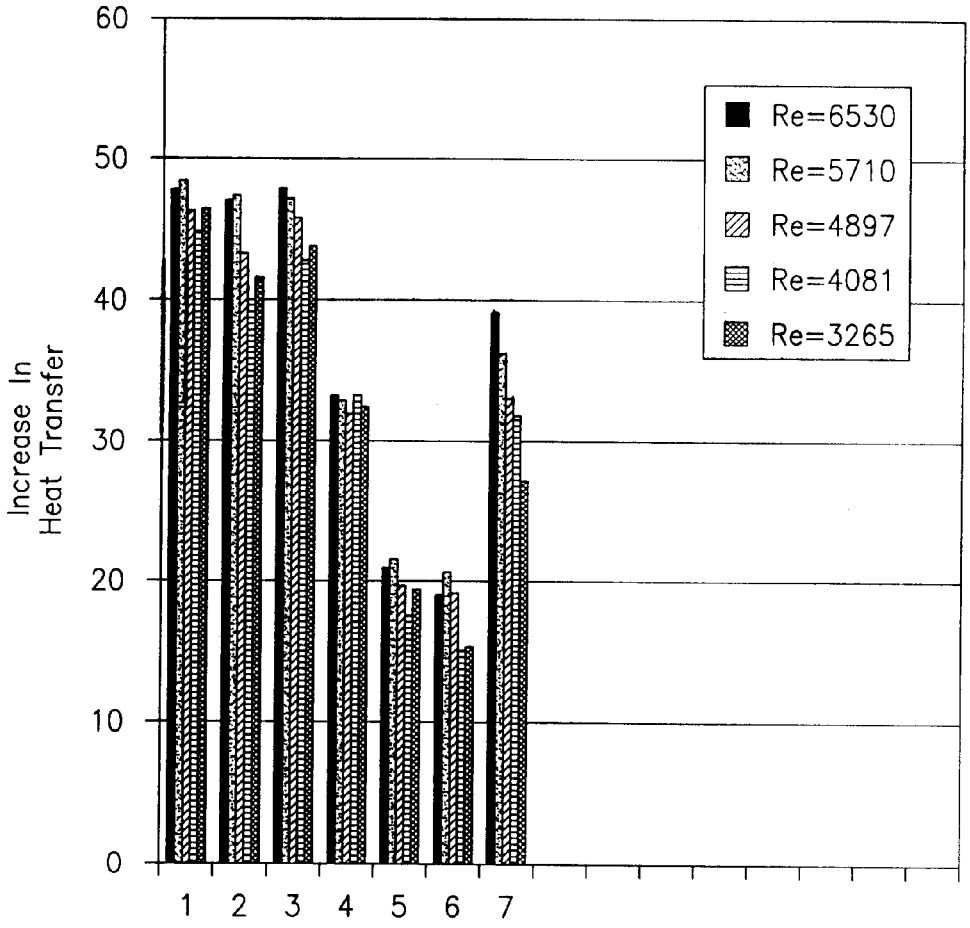
FIG. 6 is a bar graph indicating the effect on cooling efficiency for different surface augmentations.

To assess heat transfer performance, the cast plates were heated electrically at controlled heat fluxes. Metered coolant flow at varying Reynolds Numbers was supplied to the panels through a plenum. The plenum was attached to the floor of a wind tunnel. The flow and temperature in the wind tunnel was controlled to impose a fixed boundary condition during the experiment. At set coolant flow, temperatures, and heating rates, the metal plate temperature was monitored with a calibrated infrared camera. Thus, at fixed conditions, the panel temperature was indicative of the heat transfer performance. With cooled coolant, a lower panel temperature indicates better cooling efficiency. All of the cases with surface augmentation had lower measured surface temperatures than the smooth surface case (See FIG. 6). Using a one-dimensional heat transfer model and the smooth case as a baseline, this performance was quantified as a relative impingement heat removal rate. All cases demonstrated heat removal rates that were 1.2 to 1.5× (20% to 50% increase in heat transfer efficiency) over that for the smooth surface.

During these experiments, the static pressures of the coolant supply flow and the static pressure at the discharge were monitored to assess the impact of the surface augmentation on the system (liner plus shell) pressure drop. Again, comparisons are made to the cast panel with a smooth surface. The experiments show that the surface area augmentation is able to achieve this performance with no statistical increase in pressure drop. In fact, as seen in Table I, in some cases a statistical decrease was observed. In other words, at all flow rates, no increase in pressure drop was observed that exceeded the experimental measurement uncertainty.

TABLE I

| ID | Idealized Configuration | Height | Center-to-Center Spacing | Increase in Surface Area* | Increase in Pressure Drop* |
|---|---|---|---|---|---|
| 1 | Square Pin | 0.025" | 0.0225" | 296% | −7% |
| 2 | Square Pin | 0.040" | 0.030" | 355% | −5% |
| 3 | Square Pin | 0.040" | 0.0225" | 474% | −3% |
| 4 | Pyramid | 0.040" | 0.020" | 312% | −5% |
| 5 | Pyramid | 0.025" | 0.020" | 169% | −7% |
| 6 | Pyramid | 0.025" | 0.015" | 248% | −6% |
| 7 | Truncated Pyramid | 0.040" | 0.025" | 230% | −7% |

*Assume +/− 3% Uncertainty

To conclude, in a scaled laboratory experiment, a 50% increase in heat transfer augmentation was achieved at a negligible increase in pressure drop.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A combustor for a gas turbine engine comprising:

a support shell having an exterior surface, an interior surface and a plurality of impingement coolant holes extending through the support shell between the exterior surface and the interior surface;

at least one liner segment attached to the support shell, the liner segment comprising a panel having a face surface, a back surface and a plurality of coolant holes where in the back surface of the panel faces and is spaced from the the interior surface of the support shell and defines therebetween a gap, wherein at least a portion of the back surface of the panel has a surface profile for improving the heat transfer properties of the liner segment with negligible increase in pressure drop across the combustor when compared to a flat back surface of the panel, wherein the surface profile comprises an array of surface features having a height A of less than 100 mils and a spacing B of greater than 10 mils.

2. A combustor according to claim 1, wherein the surface profile increases the surface area of the back surface of the panel by at least 50% compared to the flat back surface.

3. A combustor for a gas turbine engine comprising:

a support shell having an exterior surface, an interior surface and a plurality of impingement coolant holes extending through the support shell between the exterior surface and the interior surface;

at least one liner segment attached to the support shell, the liner segment comprising a panel having a face surface, a back surface and a plurality of coolant holes wherein the back surface of the panel faces and is spaced from the interior surface of the support shell and defines therebetween a gap, wherein at least a portion of the back surface of the panel has a surface profile for improving the heat transfer properties of the liner segment with negligible increase in pressure drop across the combustor when compared to a flat back surface of the panel, wherein the surface profile increases the surface area of the back surface of the panel to between 1.5 to 4.75 times compared to the flat back surface.

4. A combustor according to claim 1 or 3, wherein the heat transfer efficiency is increased at least 20% compared to the flat back surface.

5. A combustor according to claim 4, wherein the heat transfer efficiency is increased between 20% and 50% compared to the flat back surface.

6. A combustor according to claim 1 or 3, wherein the increase in pressure drop is less than 10% compared to the flat back surface.

7. A combustor according to claim 6, wherein the increase in pressure drop is less than 5% compared to the flat back surface.

8. A combustor according to claim 1, wherein the increase in surface area is between 1.5 to 4.75 times compared to the flat back surface.

9. A combustor according to claim 1 or 3, wherein the surface profile comprises an array of surface features selected from the group consisting of square-base pins, circular-base pins, square-base pyramids, circular base cones, tapered pins, pyramids with polygonal bases, frustums conical convex cones, concave cones, serpentine micro ribs, hemispheres, dimples and combinations thereof.

10. A combustor according to claim 3, wherein the surface profile comprises an array of surface features having a height A of less than 100 mils and a spacing B of greater than 10 mils.

11. A combustor according to claim 10, wherein height A is between 4 and 45 mils and spacing B is between 15 and 50 mils.

* * * * *

UNITED STATES PATENT AND TRADEMARK OFFICE

CERTIFICATE OF CORRECTION

PATENT NO. : 6,701,714 B2
DATED : March 9, 2004
INVENTOR(S) : Steven W. Burd et al.

It is certified that error appears in the above-identified patent and that said Letters Patent is hereby corrected as shown below:

Column 1,
Line 2, after the title and before the BACKGROUND OF THE INVENTION, insert the following government rights clause:

-- U.S. GOVERNMENT RIGHTS

The invention was made with U.S. Government support under contract Nos. NAS3-01138 and NAS3-27727 awarded by NASA. The U.S. Government has certain rights in the invention. --

Signed and Sealed this

Sixteenth Day of November, 2004

JON W. DUDAS
*Director of the United States Patent and Trademark Office*